US006189347B1

(12) United States Patent
Thompson

(10) Patent No.: US 6,189,347 B1
(45) Date of Patent: Feb. 20, 2001

(54) TRAINING HANDCUFF KEY

(76) Inventor: Charles E. Thompson, 551 E. Parkway Rd., Riverside, IL (US) 60546

( * ) Notice: Under 35 U.S.C. 154(b), the term of this patent shall be extended for 0 days.

(21) Appl. No.: 09/390,237

(22) Filed: Sep. 3, 1999

Related U.S. Application Data

(60) Provisional application No. 60/104,061, filed on Oct. 13, 1998.

(51) Int. Cl.[7] ..... E05B 19/26; E05B 75/00

(52) U.S. Cl. ..... 70/16; 70/395; 70/408; 70/413; 70/430

(58) Field of Search ..... 70/16, 408, 276, 70/413, 389, 395, 403, 404, 429, 430

(56) References Cited

U.S. PATENT DOCUMENTS

| | | | | |
|---|---|---|---|---|
| 1,165,542 | * | 12/1915 | Schnerre | 70/413 |
| 1,509,335 | * | 9/1924 | Bockin | 70/16 |
| 2,975,497 | * | 3/1961 | Budreck | 24/201 |
| 3,421,348 | * | 1/1969 | Hallmann | 70/276 |
| 4,516,000 | * | 5/1985 | Ryberg et al. | 70/408 X |
| 4,744,231 | * | 5/1988 | Takagi et al. | 70/264 |
| 4,815,304 | * | 3/1989 | Kesselman | 70/276 X |
| 5,548,984 | * | 8/1996 | Miyatsu | 70/276 |
| 5,600,977 | * | 2/1997 | Piron | 70/276 X |
| 5,746,078 | * | 5/1998 | Kiernan | 70/413 X |

FOREIGN PATENT DOCUMENTS

| | | | | |
|---|---|---|---|---|
| 88210 | * | 4/1922 | (AT) | 70/276 |
| 2032943 | * | 1/1972 | (DE) | 70/413 |
| 3133093 | * | 3/1983 | (DE) | 70/408 |
| 3235322 | * | 3/1984 | (DE) | 70/276 |
| 3624138 | * | 7/1927 | (FR) | 70/408 |
| 638959 | * | 4/1962 | (IT) | 70/276 |
| 106371 | * | 10/1963 | (NL) | 70/408 |

OTHER PUBLICATIONS

IBM Technical Disclosure Bulletin, Credit Card Design, J. Svigals, vol. 9, No. 3, Aug. 1966.*

* cited by examiner

*Primary Examiner*—Lloyd A. Gall
(74) *Attorney, Agent, or Firm*—Vangelis Economou Ladas & Parry

(57) ABSTRACT

A training handcuff key for use during training of security officers in the use of handcuffs used to restrain a subject. The training key includes a magnet washer that holds the key adjacent the surface of the handcuff keyhole, even during violent jerking and/or dropping of the handcuffs during simulated apprehension situations. The training key operates in all respects as does a standard handcuff key, but includes the feature of remaining adjacent the handcuff keyhole, while having a profile which does not interfere with the training use of the handcuffs. The training key is removable after completion of the training exercises, permitting the handcuffs to be used in a standard manner. Use of the training handcuff key dramatically reduces the time required to remove the handcuffs after they have been applied to the subject, therefore allowing the trainer and the trainees more time to develop proper and efficient methods of handcuffing and dramatically improve their skills in proper handcuffing techniques.

14 Claims, 3 Drawing Sheets

Fig. 1
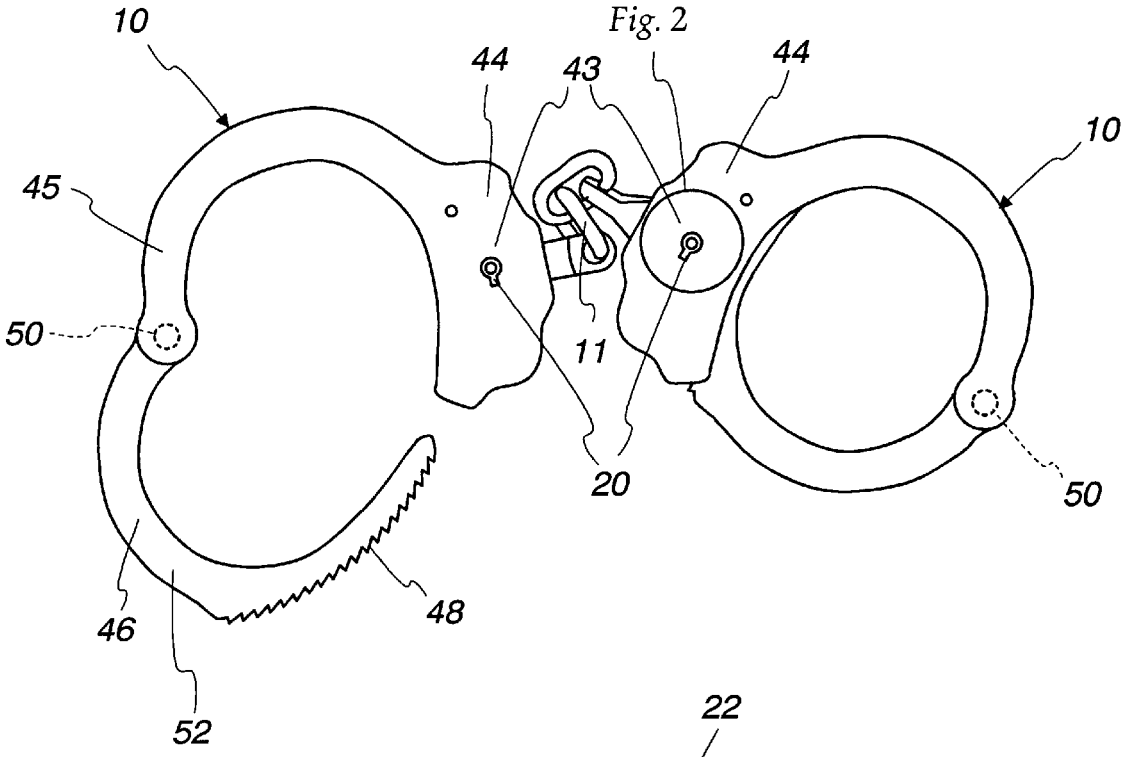
Fig. 2
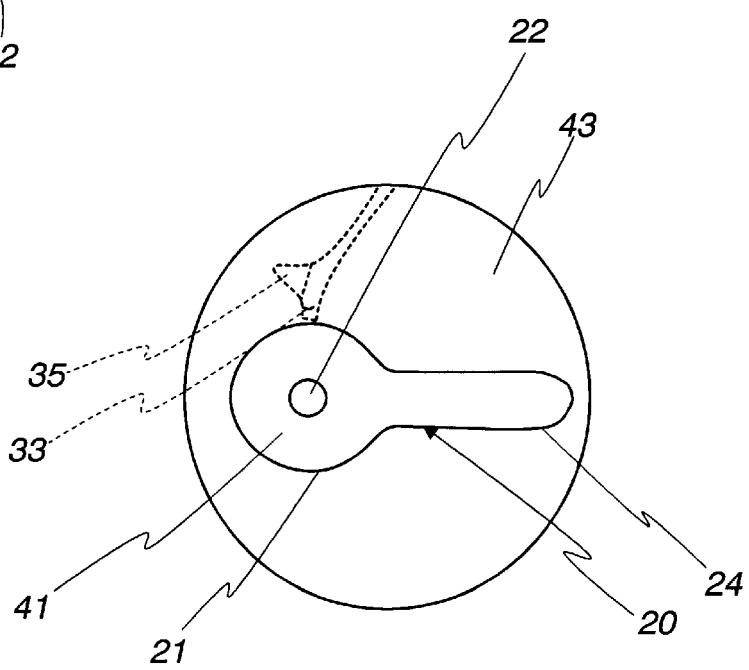
Fig. 2

TRAINING HANDCUFF KEY

CROSS-REFERENCE TO RELATED APPLICATION

This invention claims the benefit of U.S. Provisional Application No. 60/104,061, filed on Oct. 13, 1998.

BACKGROUND OF THE INVENTION

1. Field of the Invention

This invention relates generally to handcuff keys, and more specifically to removable handcuff keys used for training personnel in the art of applying handcuffs.

2. Background Art

Training for police and other security officers requires extensive familiarity with the use of handcuffs in the process of arresting a subject. Because a person being arrested may be belligerent, combative, drunk and/or uncooperative, a trainee must become prepared to handle many different situations in which handcuffs must be placed on a subject's wrists. The best type of training is considered by most experienced law enforcement instructors to be actual or simulated demonstrations during which "tactical handcuffing" is actually performed by the trainee. Even when a subject is not combative, a trainee must be able to handcuff a subject's wrists efficiently without causing pain. Such training necessarily involves repeated locking and unlocking the cuffs. A drawback to using a standard handcuff key for training is the amount of time required to locate the key, fit it into the keyhole of each handcuff, and withdrawing the key to a safe location.

Accordingly, what is considered necessary is a mechanism usable with standard return standard handcuffs which does not mechanically alter the handcuffs, which further is removable to return to standard street use mode, and which provides for easy, simple and unobstructed handcuff use training.

SUMMARY OF THE INVENTION

Accordingly, there is provided herein a training handcuff key comprising a shaft, the shaft having a spline, a spline end and a base portion end, and a mounting base which includes at least one magnetized member and a gripping member permitting turning of the key and shaft within a keyhole of a handcuff. The magnetized member preferably retains the key releasably attached to a magnetizable handcuff wall material surrounding the keyhole for training in the use of handcuffs, providing a quick release, locking mechanism for the handcuffs.

BRIEF DESCRIPTION OF THE DRAWINGS

FIG. 1 illustrates a set of standard handcuffs including an aperture for receiving a training key according to the present invention.

FIG. 2 is a detail view of the keyhole in one of the handcuffs shown in FIG. 1.

DETAILED DESCRIPTION OF THE PREFERRED EMBODIMENTS

Figure 3:
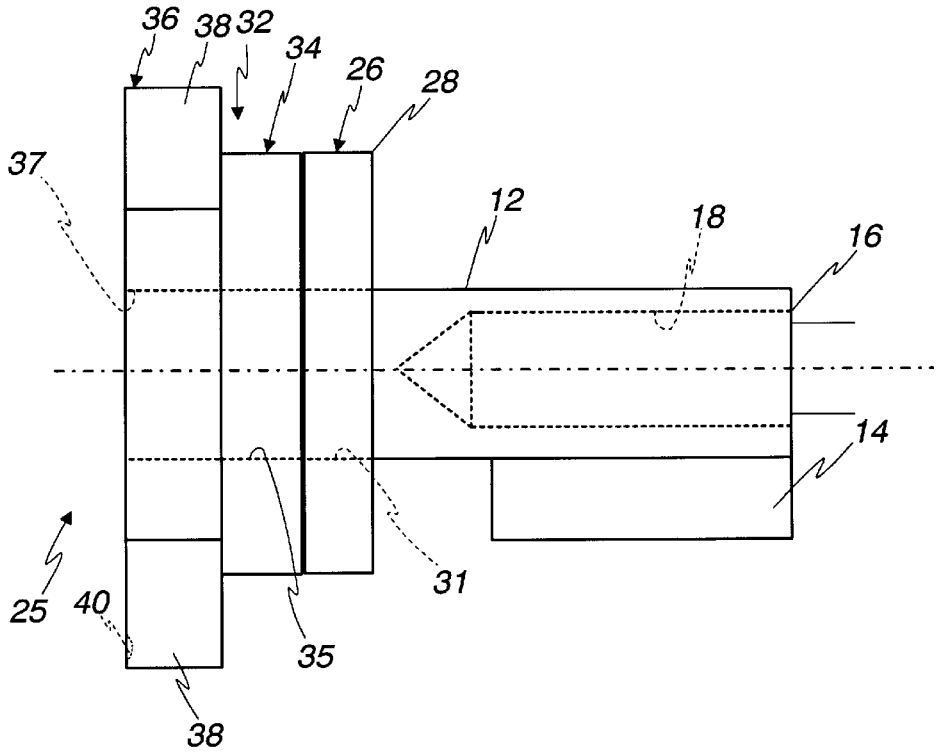
FIG. 3 is an elevational view of a handcuff training key according to the present invention.

Handcuffs are standard police and security industry related tools used for restraining, controlling or restricting the movement of unreasonable persons. FIG. 1 illustrates in an elevational view a pair of standard handcuffs 10, joined to each other by a chain 11, welded at either end to a shackle base 44 of each handcuff 10. Handcuffs 10 may also be joined by a hinge (not shown) or other known mechanism. An arcuate, rotatable shackle bracelet 46, including ratchet teeth 48, is attached to the shackle base 44 at a protruding end 45 of shackle base 44. The shackle bracelet 46 is joined to the protruding shackle end 45 at a pivot 50 which permits the shackle bracelet 46 to rotate about the pivot 50 relative to the shackle base 44. The shackle base 44 includes a flat keyhole surface 43 in which is disposed a keyhole 20.

The ratchet teeth 48 of shackle bracelet 46 are disposed at a distal end 52 of the shackle bracelet 46 and are spaced from the proximate end which attaches the shackle bracelet 46 at pivot 50. The shackle bracelet end 52 is shaped and dimensioned to be inserted and to slide into an elongated base opening, also referred to as a bail, (not shown in this view), of the shackle base 44. Insertion of the shackle bracelet end 52 into the bail in a direction that closes the opening defined by the shackle base 44 and shackle bracelet 46 causes the ratchet teeth 48 to engage a one-way pawl (not shown in this view) located within the shackle base 44.

The pawl operates in a conventional manner to engage ratchet teeth 48 so as to inhibit the opening of the handcuffs 10 once they have been used to shackle an object. If the handcuffs 10 are being placed around an object, for example a wrist, successive ratchet teeth 48 are engaged by the pawl until further insertion of the shackle bracelet 46 into the bail is restricted by the restrained object. For some handcuffs, the bail has a construction that permits the shackle bracelet 46 to slide completely through the base 44 and to complete a revolution about the pivot 50 if no object is present to stop the rotation of the shackle bracelet 46.

The ratchet teeth 48, by engagement with the pawl, restrict the counter-rotation of the shackle bracelet 46 in the opening direction, opposite to that of the closing direction. To release an object which has been shackled by the handcuff 10, a lock release mechanism disengages the one-way pawl from the ratchet teeth 48, releasing the shackle bracelet 46 to rotate in the opening direction, thereby expanding the opening between the shackle base 44 and the shackle bracelet 46. When the last ratchet 48 clears the pawl, the shackle extension 46 is free to rotate about pivot 50, and opening the bracelet permits removal of the restrained object, e.g., wrist, from the handcuffs 10.

The locking mechanism for release of the pawl includes a standard lock and key mechanism, to which keyhole 20 provides access. The keyhole 20, shown in a detailed view in FIG. 2, normally comprises a rounded portion 21 for receiving a shaft of a key (not shown in this view) and a slot portion 24 for receiving the key spline, such as spline 14 (FIG. 3), which extends radially from the shaft. A spline 14 is normally a flattened key spline attached to one end of the shaft 12 of the key 25 (FIG. 3).

The detail view of keyhole 20 (FIG. 2) further illustrates a standard orientation pin 22 which is centrally disposed in the keyhole rounded portion 21 and is attached to an inner wall 41 within the shackle base 44. The pin 22 extends within the base 44 from inner wall 41 outwardly toward the outer surface of the shackle base 44, but ideally does not extend fully to that surface. The orientation pin 22 is used to position the key 25 so that the spline can properly engage a pawl lever 33 (shown in phantom in FIG. 2) which in turn translates releases the pawl 35 (shown in phantom in FIG. 2), so as to release the ratchet teeth.

As illustrated in FIG. 3, a training handcuff key 25 according to the present invention comprises a key shaft 12, a magnet washer 26 and a knob assembly 32. The key shaft 12 preferably is cylindrical in shape, the cylinder having dimensions permitting its insertion within the keyhole rounded portion 21. The shaft 12 further comprises a pin end 16, and a longitudinal bore 18 concentric with the centerline CL extending through the shaft 12 from the pin end 16 toward the base portion end 19. A flat, thin spline 14 extends radially from the shaft 12 adjacent the pin end 16.

The dimensions of the bore 18 allow the guiding pin 22 located in the keyhole 20 to fit into the hollow bore 18 of the key shaft 12 with sufficient clearance so that the key shaft 12 can rotate about the centerline CL while pin 22 is within bore 18. The shaft 12 further comprises a base portion end 19, disposed longitudinally opposite the shaft 12 from the pin end 16, as will be described in greater detail with reference to FIG. 5.

The key shaft 12, including appropriate dimensions of bore 18 and spline 14, is designed to fit the standard locking mechanism in most police issue handcuffs. It will be understood that the key shaft 12 can be modified to fit other locking mechanisms, as well, for non-standard issue handcuffs (not shown). In most respects, the key shaft 12 and spline 14 mirrors the identical items in a standard handcuff key.

The knob assembly 32 preferably comprises a mounting base 34 and a gripping section 36. The mounting base 34 preferably comprises a cylindrical magnetizable member, preferably metal, having a predetermined diameter and circumferential shape. The mounting base 34 is concentric to the shaft 12, and has a diameter which is significantly larger than that of the rounded portion 21 of keyhole 20. Although shown as two separate members 34,36 in FIGS. 3 and 5, the knob assembly 32 may be constructed as a unit in an alternate embodiment.

The gripping section 36 of the knob assembly is preferably constructed to provide a gripping surface disposed along the axial and circumferential directions. Preferably, the shape of the gripping section 36 is of a hexagonal cylinder, similar to a nut, that is concentric to the shaft 12. The flats 38 gripping section 36 should provide a good gripping surface for fingers of an average hand, and may be knurled or otherwise scored to provide a frictional engagement with a user's fingers.

The diameter of the hexagonal gripping section 36, as measured between opposite flats 38, preferably is somewhat larger than that of the mounting base 34. The shape of the gripping section 36 allows the user to easily grip the knob assembly 32 and turn the knob assembly 32 and shaft 12 in either the clockwise or counterclockwise direction.

The gripping section 36 further includes an aperture 37 into which a shaft mounting portion 42 (FIG. 5) of shaft base portion end 19 is attached, preferably by insertion. The shaft 12 is thus securely attached to the gripping section 36 by interference fit between the shaft mounting portion 42 and the aperture 37, or by gluing, welding or other appropriate attachment mechanism. The gripping section 36 also preferably comprises a magnetizable metal, but this is not a requirement. Alternatively, the gripping section 36, the mounting base 34 and the shaft are integral and manufactured as a unit, the complete gripping section comprising a magnetizable material, and a magnet washer (not shown) being attached to the shaft at an appropriate position.

The magnet washer 26 preferably is a circular disk having two flat sides 28,30 and a central aperture 31. Magnet washer 26 is connected to the key shaft 12 by insertion of key shaft 12 into the aperture 31 in a concentric configuration so that both the flat sides 28,30 of the magnet washer 26 are at right angles to the shaft centerline CL. The second flat side 30 of the magnet washer 12 is adjacent the base 34. The diameter of the magnet washer 26 also must be larger than the diameter of the keyhole aperture 20, to ensure that only the key shaft 12 can enter the keyhole 20. In an alternative embodiment, the magnet washer may be a similar disk (not shown) to washer 26 that is cracked or broken at appropriate opposite disposed positions. The broken disk can be attached around the shaft of a key by gluing, the two half disks of the magnet washer also having opposite polarity and thus attracting each other magnetically.

In the preferred configuration, the surface 28 of magnet washer 26 is retained perpendicular to the shaft centerline CL, and insertion into the keyhole causes the surface 28 to lay flat against the keyhole surface 43 of the shackle base 44. Flat engagement of the magnet surface 28 against the flat, smooth surface 43 of the handcuff base 44 releasably and securely attaches the training handcuff key 25 within the keyhole 20.

Figure 4:
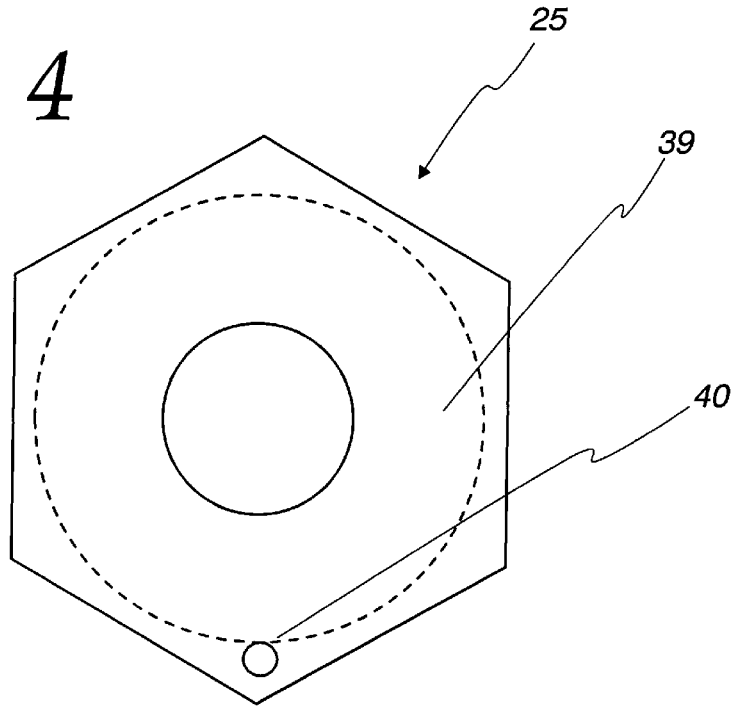
FIG. 4. is a view of the handcuff training key shown in FIG. 3.

Referring now to FIGS. 3 and 4, a reference dot 40 is disposed adjacent the edge of the upper surface 39 of the gripping section 36 to facilitate easy removal of the key 25. The radial location of the reference dot 40 on the surface 39 corresponds to the radial position of the spline 14 on the key shaft 12. This allows the user to know in which direction the spline 14 is pointing when the key shaft 12 and spline 14 are inserted into a keyhole 20 and the visibility of spline 14 is blocked by wall 43.

The reference dot 40 is preferably a spherical indentation in the upper surface 39 of the gripping section 36. However, the reference dot 40 can also take the form of grooves, stickers or other marking devices, as appropriate. The indentation of reference dot 40 is preferably deep enough to be felt by the fingertips of a user.

Proper use of this invention causes the handcuff key 25 to remain in place within the keyhole 20 even through jarring or violent movements of the training subjects, which are sometimes necessary to simulate actual apprehension situations. The magnetic pull of magnet washer 26 is strong enough to ensure that the device will not be dislodged from the keyhole 20 if the handcuffs 44 are moved around violently or dropped.

Rotating the gripping portion 36 causes the key shaft 12 and spline 14 to rotate inside the keyhole 20. The magnet washer 26 retains the key 25 releasably attached to the base surface 43 by magnetic attraction, since most handcuffs are manufactured from stainless steel. As the key shaft 12 rotates, the spline 14 interacts with the pawl 33 located in the locking mechanism, removing the pawl 35 from engagement with the ratchet teeth (not shown in this view), thereby causing the handcuffs 10 to unlock. The gripping portion 36 can be turned in either clockwise or counterclockwise directions allowing the user to lock and unlock a double lock mechanism, a standard feature of most standard handcuffs.

The handcuffs 10 can also be used in their normal, non-training operation as the training keys 25 can be easily removed by aligning the reference dot 40 and the spline 14 with the slot 24 of keyhole 20. The user can then pull the keys 25 out of the keyholes 20, thereby removing them.

Thereafter, standard handcuff keys may then be used to lock and unlock the handcuffs 10. The inventive training keys 25 can be re-used in training by reattaching the keys 25 to the handcuffs 10 as described above.

An inventive key 25 is constructed by inserting the base portion end 19 of key shaft 12, including an integral spline 14, through apertures 31, 35, 37 in the magnet washer 26, in the mounting base 34 and in the gripping section 36, respectively. Care must be taken in the insertion of the shaft into aperture 37 of the gripping section 36 so that the spline 14 is in the same radial position relative to the centerline CL as the reference dot 40.

Figure 5:
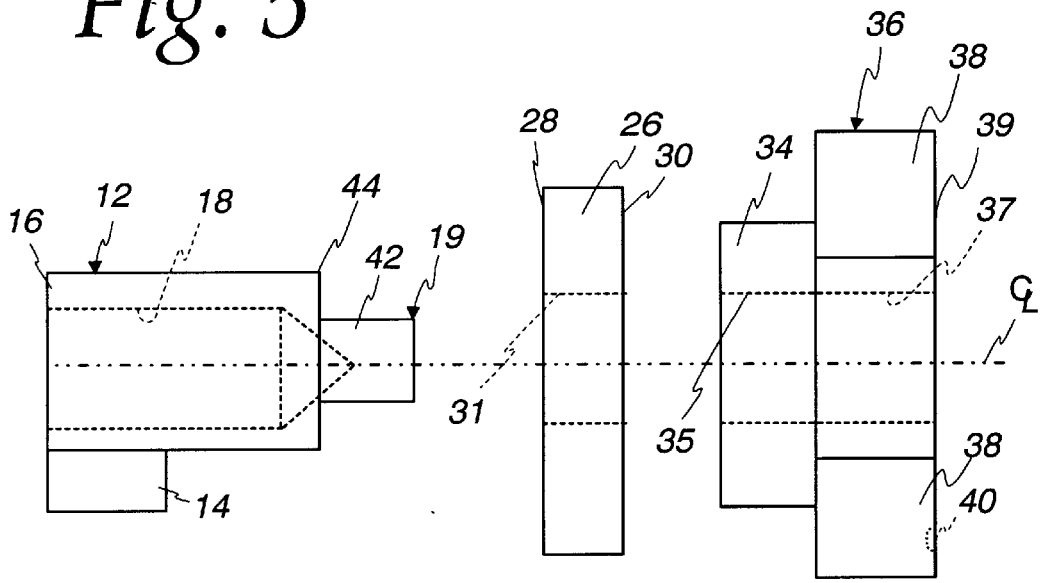
FIG. 5. is an exploded view of the handcuff key according to the present invention.

Referring now to the exploded view of FIG. 5, it can be seen that shaft 12 of key 25 includes a shaft mounting portion 42, having a shaft diameter that is somewhat smaller than the diameter of shaft 12 adjacent the pin end 16. The change in diameter provides a shoulder 44 which acts as a stop for the magnet washer 26. The magnet washer 26 has a central bore 31 into which shaft mounting portion 42 is inserted. The shoulder 44 engages surface 28 of the magnet washer 26 to retain the washer in place.

The mounting base 34 also has a central aperture 35 into which shaft mounting portion 42 is also inserted. The gripping section aperture 37 has a diameter exactly at or more preferable slightly smaller than the diameter of shaft mounting portion 42 to provide an interference fit, and to secure the gripping portion 36 onto the shaft mounting portion 42, thereby retaining the mounting base 34 and magnet washer 26 on the shaft 12. The axial length of the shaft mounting portion 42 is approximately equal to the combined widths of the magnet washer 26, the mounting base 34 and the gripping portion 36, thus ensuring that the shaft mounting portion 42 does not protrude beyond the upper surface 39 of the gripping portion 36.

Figure 6:
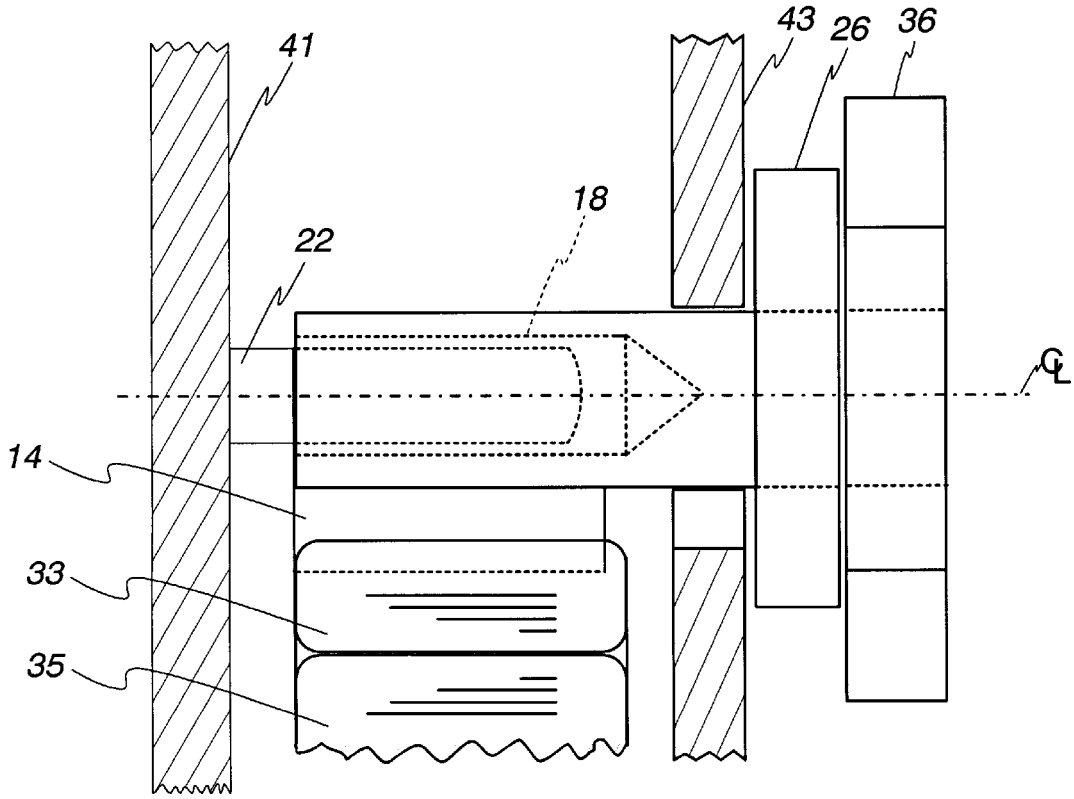
FIG. 6. illustrates the use of an alternative embodiment of the handcuff training key according to the invention in a cross-sectional view of the handcuff walls and keyhole.

Referring now to the partial cross-sectional view of FIG. 6, use of an alternative embodiment of the inventive key 25 is illustrated. The pin end 16 of key 25 is inserted into the keyhole 20, the shaft 12 being aligned with the keyhole rounded portion 21 and the spline 14 clearing the keyhole 20 by means of the slot portion 24. Perpendicular orientation of the shaft 12 to the surface 43 of the handcuff base 44 causes the shaft bore 18 to fit over the guiding pin 22. Bore 18 has a dimension which inhibits the spline end 16 of the key shaft 12 from reaching the inner wall surface 41 of the shackle base 44. The magnet washer 26 has sufficient magnetic attraction to retain the knob assembly 32, in this embodiment comprising only the gripping portion 36, adjacent the surface 43 of the shackle base 44. Thus attached, the key 25 does not fall out of the keyhole 20, irrespective of the angular position of the key spline 14 within the keyhole or any violent jarring of the handcuffs 10.

Rotation of the gripping section 36 causes angular rotation of the spline 14 around the pin 22. The dimensions of the spline 14 and the pawl lever 33 are arranged to engage, as shown, when the angular position of the spline 14 is rotated within the walls of the handcuff 10. Rotating the gripping section 36 in one direction double locks the handcuffs 10, while rotating in the other direction translates the pawl lever 33 to release the pawl 35 from the ratchet teeth (not shown in FIG. 6).

Rotation of the training handcuff key 25 provides a similar, if not identical, function to that of a standard handcuff key, and further provides two essential features of the present invention. First, the magnet washer 26 retains the knob assembly 32 against the wall 43 and the key 25 within the keyhole 20 at all times during a training session, including when the handcuffs are dropped or violently jarred. Of course, releasably attaching the key 25 within the keyhole 20 is done without interfering with the function of the spline end of the key 25, which is free to rotate and lock and unlock the handcuffs at will.

A second feature is that the gripping section surface 39 is preferably as close to and as parallel as possible to the surface 43 of the shackle base 44. Although shown as a flat surface 39, the outer surface of gripping section 36 may be slightly rounded or otherwise beveled. Thus, the training handcuff key 25 does not interfere with the training of use of the handcuffs 10, in the manipulation of the handcuffs to restrain a subject or in storage of the handcuffs in a container, e.g., a handcuff holster.

However, the handcuff key 25 should be removable from standard issue handcuffs, which permits the same handcuffs to be utilized following their use for training.

These and other features which are variants of this invention will become apparent to a person of ordinary skill in the art once a full understanding of the inventive features is achieved. Thus, the preceding description of the preferred embodiments is provided for illustrative purposes only, and not for purposes of limitation, the scope of the invention only being limited by the following claims.

What is claimed is:

1. A training handcuff key temporarily attachable to the handcuffs with which said key is intended to be used, said key comprising:

(a) a shaft having a longitudinal axis, a predetermined diameter, a spline end and a base portion end;

(b) a spline attached to said shaft at or adjacent said spline end;

(c) a mounting base attached to said base portion end, said mounting base having a lateral dimension significantly greater than the shaft diameter; said base including at least one member which is magnetized; and a gripping portion at the longitudinal base portion end of said training key shaft.

2. The training handcuff key according to claim 1 wherein said gripping portion further comprises an outer surface extending essentially laterally to said shaft axis.

3. The training handcuff key according to claim 1 wherein the longitudinal thickness of said mounting base is approximately the length of the shaft extending from said mounting base to said spline end.

4. The training handcuff key according to claim 1 wherein said mounting base comprises a magnet washer, a base member and a gripping member, each having a central aperture through which said base portion end of said shaft is inserted.

5. The training handcuff key according to claim 4 wherein said magnet washer is closest to said spline end of said shaft, said gripping member is farthest from said spline end of said shaft and said base member is disposed between said magnet washer and said gripping member.

6. The training handcuff key according to claim 1, wherein said gripping portion comprises an outer surface furthest from said spline end, said outer surface being essentially perpendicular to a shaft centerline and said outer surface being parallel and close to the surface of the handcuff adjacent the handcuff keyhole when in use.

7. The training handcuff key according to claim 6, wherein said outer surface includes a reference dot at a periphery thereof, the angular position of said reference dot being at similar angles relative to the shaft to the angular position of said spline.

8. The training handcuff key according to claim 1, wherein said mounting base is an integral unit comprising a gripping portion, and a magnetized portion disposed longitudinally inward from said gripping portion.

9. The training handcuff key according to claim 1, wherein said shaft spline end further includes a longitudinal bore extending inwardly from said spline end for receiving an orientation pin disposed within the handcuffs for orienting said key during insertion.

10. The training handcuff key according to claim 1, wherein said shaft base portion end is defined by an annular shoulder against which said at least one magnetized member abuts.

11. The training handcuff key according to claim 2 wherein said magnetized member presents a planar disc which has surfaces parallel to the outer surface of said gripping portion.

12. The training handcuff key according to claim 1 wherein said at least one magnetized member is a disc having surfaces extending outwardly from said shaft.

13. The training handcuff key according to claim 4 wherein said magnet washer is in the shape of a disc.

14. The training handcuff key according to claim 13 wherein said magnet washer has an inner diameter slightly larger than the diameter of the shaft.

* * * * *